US007621027B2

(12) United States Patent
Biterman

(10) Patent No.: US 7,621,027 B2
(45) Date of Patent: Nov. 24, 2009

(54) CASKET AND BURIAL ACCESSORY INCORPORATING NATURAL MATERIALS FROM A LOCATION HAVING SENTIMENTAL CONNECTION TO A DECEASED

(75) Inventor: Eran Biterman, Kiryat Ata (IL)

(73) Assignee: Betercare Ltd., Kiryat Ata (IL)

( * ) Notice: Subject to any disclaimer, the term of this patent is extended or adjusted under 35 U.S.C. 154(b) by 343 days.

(21) Appl. No.: 11/223,874

(22) Filed: Sep. 8, 2005

(65) Prior Publication Data

US 2007/0050959 A1 Mar. 8, 2007

(51) Int. Cl.
*A61G 17/00* (2006.01)

(52) U.S. Cl. ..... 27/19; 27/27; 27/28

(58) Field of Classification Search ..... 27/2, 27/19, 27, 28, 1; D99/2, 9, 10; 156/60; 264/511; 110/341; 428/542.4; 47/56
See application file for complete search history.

(56) References Cited

U.S. PATENT DOCUMENTS

| | | | | | |
|---|---|---|---|---|---|
| 937,086 | A | * | 10/1909 | Montross | 27/27 |
| 4,137,613 | A | * | 2/1979 | Ceresko | 27/19 |
| 4,139,918 | A | | 2/1979 | Covington | 5/186.1 |
| 4,156,956 | A | * | 6/1979 | Partridge et al. | 27/4 |
| 4,399,596 | A | | 8/1983 | Parlour et al. | 27/4 |
| 4,759,105 | A | | 7/1988 | Buerosse | 27/1 |
| 4,951,367 | A | * | 8/1990 | Wolfe | 27/19 |
| 5,016,330 | A | * | 5/1991 | Botsch | 27/1 |
| 5,140,728 | A | * | 8/1992 | Chandler et al. | 27/35 |
| 5,341,548 | A | | 8/1994 | Zerick | 27/28 |
| RE34,846 | E | * | 2/1995 | McGuire | 27/19 |
| 5,586,376 | A | * | 12/1996 | Enneking et al. | 27/27 |
| 6,282,763 | B1 | | 9/2001 | Goria | 27/35 |
| 6,317,944 | B1 | * | 11/2001 | Beaulieu et al. | 27/4 |
| 6,574,840 | B1 | * | 6/2003 | Doppel | 27/2 |
| 6,615,463 | B1 | * | 9/2003 | Hojaji | 27/1 |
| 7,197,794 | B2 | * | 4/2007 | Davis et al. | 27/19 |

(Continued)

FOREIGN PATENT DOCUMENTS

JP 55114712 A * 9/1980

(Continued)

*Primary Examiner*—William L. Miller
(74) *Attorney, Agent, or Firm*—Zaretsky Patent Group PC; Howard Zaretsky

(57) ABSTRACT

A novel casket and burial accessory for use in the burial or interment process that incorporates soil or some other natural material from a specific location to which the deceased and/or their family has a sentimental or religious connection. The natural material selected for use with the invention is chosen to represent or embody a connection between the deceased, his family and relatives and to a particular land thus expressing their religious beliefs, yearning or some other connection to the land from which the natural material is from. The burial accessory is constructed as a rigid, semi-rigid or flexible platform with a natural material affixed to its surface using glue or adhesive. The burial accessory can be adapted to be affixed to a casket on its underside, placed under the deceased inside the casket or under the deceased. A casket liner impregnated or covered with a natural material is adapted to be placed inside a casket. The natural material can be affixed directly to the interior and/or exterior portions of a casket. An elongated cloth or plastic bag containing the natural material can be placed under the deceased within the casket.

24 Claims, 9 Drawing Sheets

U.S. PATENT DOCUMENTS

| | | | | |
|---|---|---|---|---|
| 7,200,906 | B2 | 4/2007 | Darst et al. | 27/2 |
| 7,204,003 | B2 * | 4/2007 | Davis et al. | 27/2 |
| 7,322,079 | B2 * | 1/2008 | Davis et al. | 27/19 |

FOREIGN PATENT DOCUMENTS

| | | | | |
|---|---|---|---|---|
| JP | 55114713 | A | * | 9/1980 |
| JP | 2002293606 | A | * | 10/2002 |

* cited by examiner

CASKET AND BURIAL ACCESSORY INCORPORATING NATURAL MATERIALS FROM A LOCATION HAVING SENTIMENTAL CONNECTION TO A DECEASED

FIELD OF THE INVENTION

The present invention relates to the field of burial accessories and more particularly relates to a casket and burial accessory therefore incorporating soil or other natural materials that express a sentimental or religious connection between the deceased and a specific location.

BACKGROUND OF THE INVENTION

In many parts of the world, burial of the body of the deceased is the method most widely practiced upon death of a person. For many people, the soil or other natural material from their home country or country of origin has great importance. The reasons can be anything but typically a person has a sentimental connection to a certain place (i.e. country of origin) based on religious beliefs. For example, the soil from the Holy Land has great religious significance to Christians and Jews since both religions have origins in that land.

In addition, many people live their lives in a country other than the one they were born in or grew up in and have a deep yearning for their homeland. For many of these people, although they currently live in a country which is not their homeland, they ideally would like to be buried in their homeland. Often times, however, burial in their country of origin or homeland is either not practical or too cost prohibitive.

Thus, there is a need for a casket or burial accessory that can be used in the burial process that incorporates soil or some other natural material from a specific country to which the deceased and/or their family has a sentimental connection.

SUMMARY OF THE INVENTION

The present invention provides a solution to the problems of the prior art by providing a casket and burial accessory for use in the burial or interment process that incorporates soil or some other natural material from a specific location to which the deceased and/or their family has a sentimental or religious connection.

The natural material selected for use with the invention is chosen to represent or embody a connection between the deceased, his family and relatives and to a particular land thus expressing their religious beliefs, yearning or some other connection to the land from which the natural material is from.

In one embodiment, the burial accessory comprises a rigid or flexible platform with a natural material adhered to the surface of the platform. The burial accessory can be adapted to be affixed to a casket on its underside, placed under the deceased inside the casket or under the deceased if buried without a casket as is the custom in many places.

In another embodiment, the natural material is impregnated within the platform thus eliminating the requirement of adhering the natural material to its surface. Further, a shortened platform is described that is adapted to lie under the head portion only of the deceased.

Alternatively, the natural material is adhered to inner and/or outer portions of a casket without the use of a platform. One or more cloth or plastic bags containing the natural material is placed under the deceased within the casket or scattered throughout the casket. An elongated cloth or plastic bag containing the natural material is placed under the deceased within the casket or without the casket if a casket is not used in the burial process.

Another embodiment comprises a liner to be placed within the casket that is at least partially coated or impregnated with a natural material. The liner can be constructed as a single piece or a plurality of panels that are adapted to be affixed to the inner walls of the casket.

The natural material coating can be applied to the platform or casket using a suitable process. For example, the natural material can be applied using a sprayer, brush, trowel or any other suitable method.

There is therefore provided in accordance with the present invention an accessory for burial comprising a natural material obtained from a specific location, the natural material selected to express a connection between a deceased and the specific location and a substantially planar platform adapted to be at least partially covered by the natural material and operative to be used in a burial process.

There is also provided in accordance with the present invention a method of manufacture of an accessory for use in a burial process, the method comprising the steps of forming an elongated substantially planar platform adapted to be used in a burial process, applying an adhesive coating to those portions of the platform desired to be covered with a natural material having a sentimental or religious value for a deceased, applying the natural material to the adhesive and permitting the adhesive to dry, permanently adhering the natural material to the platform, providing the burial accessory.

There is further provided in accordance with the present invention a method of manufacture of an accessory for use in a burial process, the method comprising the steps of mixing a natural material, obtained from a specific location and chosen to express a connection between a deceased and the specific location, with plastic resin material to yield a plastic combination therefrom, molding the plastic combination to produce a molded plastic having a desired shape and permitting the molded plastic to cure such that the natural material is embedded in the molded plastic, providing the burial accessory.

There is also provided in accordance with the present invention a method of manufacture of a casket, the method comprising the steps of forming a substantially rectangular shaped casket body comprising a base, four upwardly extending peripheral walls and a lid, the base, the four peripheral walls and the lid defining an interior and an exterior surface of the casket body, applying an adhesive coating to those portions of the interior and exterior surfaces desired to be covered with a natural material having a sentimental or religious value for a deceased, applying the natural material to the adhesive and permitting the adhesive to dry, permanently adhering the natural material to the interior surface of the casket body.

There is further provided in accordance with the present invention a casket comprising a substantially rectangular shaped casket body comprising a base, four upwardly extending peripheral walls and a lid, the base, the four peripheral walls and the lid defining an interior surface of the casket body and a natural material, obtained from a specific location and chosen to express a connection between a deceased and the specific location, permanently adhered to one or more portions of the interior surface of the casket body.

There is also provided in accordance with the present invention a casket assembly comprising a substantially rectangular shaped casket comprising a base, four upwardly extending peripheral walls and a lid, the base, the four peripheral walls and the lid defining an interior surface of the casket, at least one bag containing a natural material, obtained from a specific location and chosen to express a connection between a deceased and the specific location and wherein the at least one bag of natural material placed within the interior of the casket.

There is further provided in accordance with the present invention a liner for use in a casket comprising a substantially rectangular shaped body comprising a base and four upwardly extending peripheral walls defining an interior surface of the body and a natural material, obtained from a specific location and chosen to express a connection between a deceased and the specific location, permanently adhered to one or more portions of the interior surface of the body.

There is also provided in accordance with the present invention a casket assembly comprising a substantially rectangular shaped casket comprising a base, four upwardly extending peripheral walls and a lid, the base, the four peripheral walls and the lid defining an interior surface of the casket, a substantially rectangular shaped liner comprising a base and four upwardly extending peripheral walls defining an interior surface of the liner, the liner operative to be inserted into the interior portion of the casket and a natural material, obtained from a specific location and chosen to express a connection between a deceased and the specific location, permanently adhered to one or more portions of the interior surface of the liner.

BRIEF DESCRIPTION OF THE DRAWINGS

The invention is herein described, by way of example only, with reference to the accompanying drawings, wherein.

DETAILED DESCRIPTION OF THE INVENTION

The present invention is a casket and burial accessory for use in the burial or interment process that incorporates soil or some other natural material from a specific location to which the deceased, family or relatives has a sentimental or religious connection. The natural material selected for use with the invention is chosen to represent or embody a connection between the deceased, his family and relatives and to a particular land thus expressing their religious beliefs, yearning or some other connection to the land from which the natural material is from.

Note that throughout this document, the term natural material is defined as any natural substance, matter or substance naturally found in a particular location (e.g., country) that has either a religious connection, sentimental meaning, yearning for or any other type of important or meaningful connection to the deceased and/or their family, relatives, friends, etc. An example of a natural material is soil from the Holy Land (i.e. Israel) which has deep spiritual and religious important to Jews, Christians and other religions.

The accessory for burial of the present invention is adapted to contain soil or other natural material that is suitable for use in the burial process. Alternatively, the burial accessory can be fitted in one of several ways with a casket. The invention thus creates a connection between the deceased and a particular land or location, the source of the natural material, thereby enabling the expression of a religious or other belief. Numerous applications of the invention are described in the embodiments provided infra whereby each is based on the principle of symbolizing the religious, spiritual or other connection between the natural material and the land, country or location from which it came.

Figure 1:
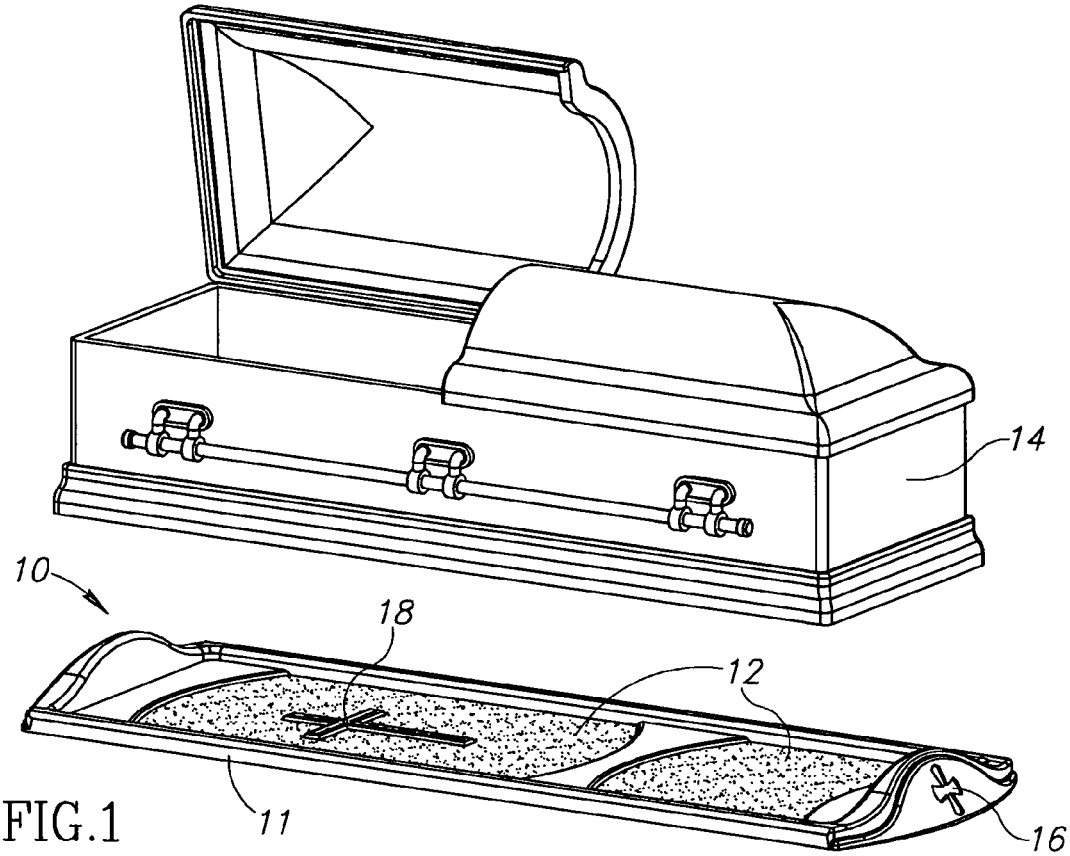
FIG. 1 is a diagram illustrating the burial accessory of the present invention containing a natural material and adapted to be affixed to the underside of a casket.

A diagram illustrating the burial accessory of the present invention containing a natural material and adapted to be affixed to the underside of a casket is shown in FIG. 1. The burial accessory, generally referenced 10, comprises a platform 11, natural material coating 12, optional religious or other symbols 16, 18. The platform comprises an elongated substantially planar and rectangular rigid or semi-rigid board that is covered with soil or other natural material and adapted to be placed under a casket 14, affixed to the underside of a casket as a bottom platform or placed under a corpse as a bottom platform in the case no casket is used in the burial process. The platform may be constructed from any suitable material such as plastic, wood, metal, ceramic or any other rigid or semi-rigid material.

The platform 11 is covered with soil or other natural material 18. The entire platform or one or more portions of the platform may be covered with the natural material. The platform may optionally include one or more religious or other type symbols. In the example embodiment shown in FIG. 1, the platform displays two crosses 16, 18. These may be replaced with any other symbols in accordance with the particular religion of the deceased. These may or not be covered by the natural material depending on the particular application.

The method of covering the platform with the natural material may comprise any suitable method. One method comprises applying an adhesive coating to those portions of the platform to be covered with the natural material. The natural material is then applied to the wet adhesive. Once the adhesive dries or cures, the natural material is permanently boded to the surface of the platform.

Figure 2:
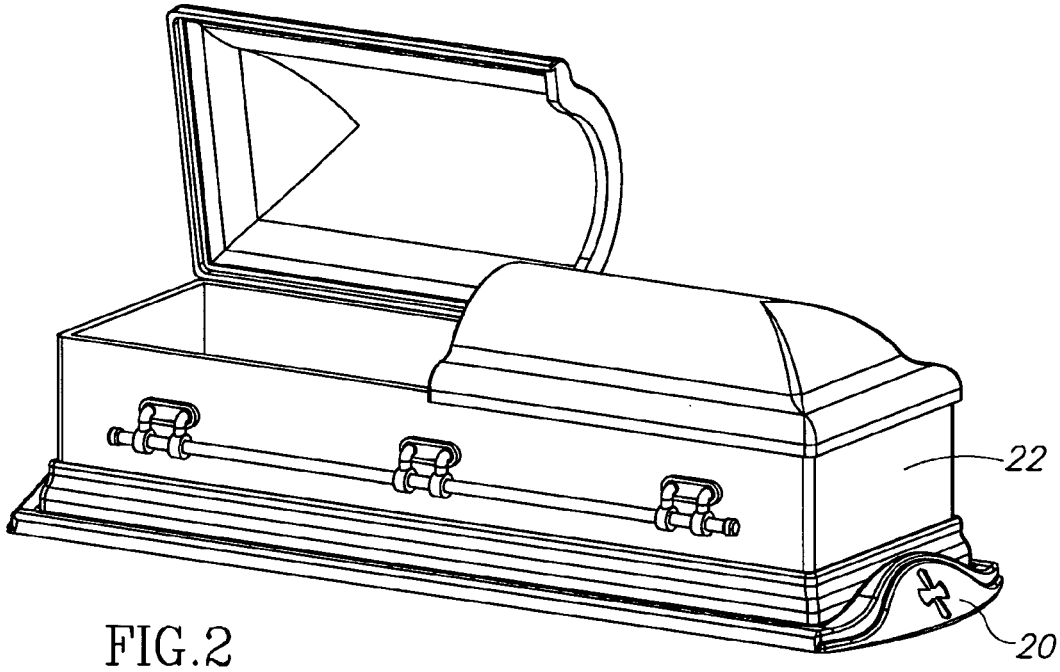
FIG. 2 is a diagram illustrating the burial accessory affixed to the underside of a casket.
Figure 3:
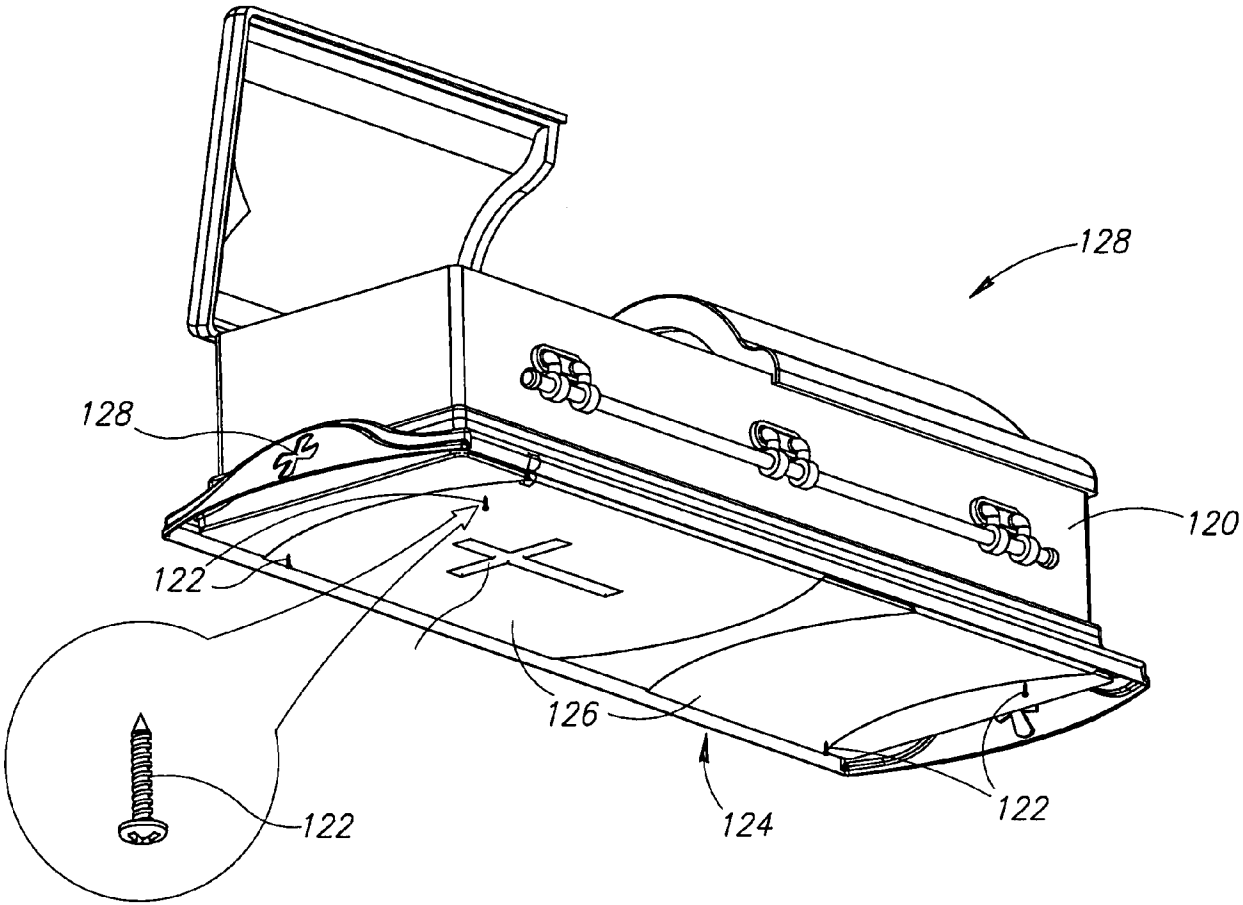
FIG. 3 is a diagram illustrating an example means of attaching the burial accessory to the underside of a casket.

A diagram illustrating the burial accessory affixed to the underside of a casket is shown in FIG. 2. The burial accessory 20 of FIG. 1 is adapted to be either placed under the casket 22 or affixed to the underside of the casket. Any suitable means of attachment can be used. The actual means of attachment used is not critical to the invention. One example means of attachment is shown in FIG. 3 wherein the burial accessory 124, comprising optional religious symbols 128 and partially covered with a natural material 126, is attached to the casket 120 using a plurality of screws 122. It is appreciated that the burial accessory can be affixed to the underside of the casket using any suitable attachment means, including but not limited to screws, bolts, nuts, nails, glue, adhesive, staples, rivets or any other fastening means.

Figure 4:
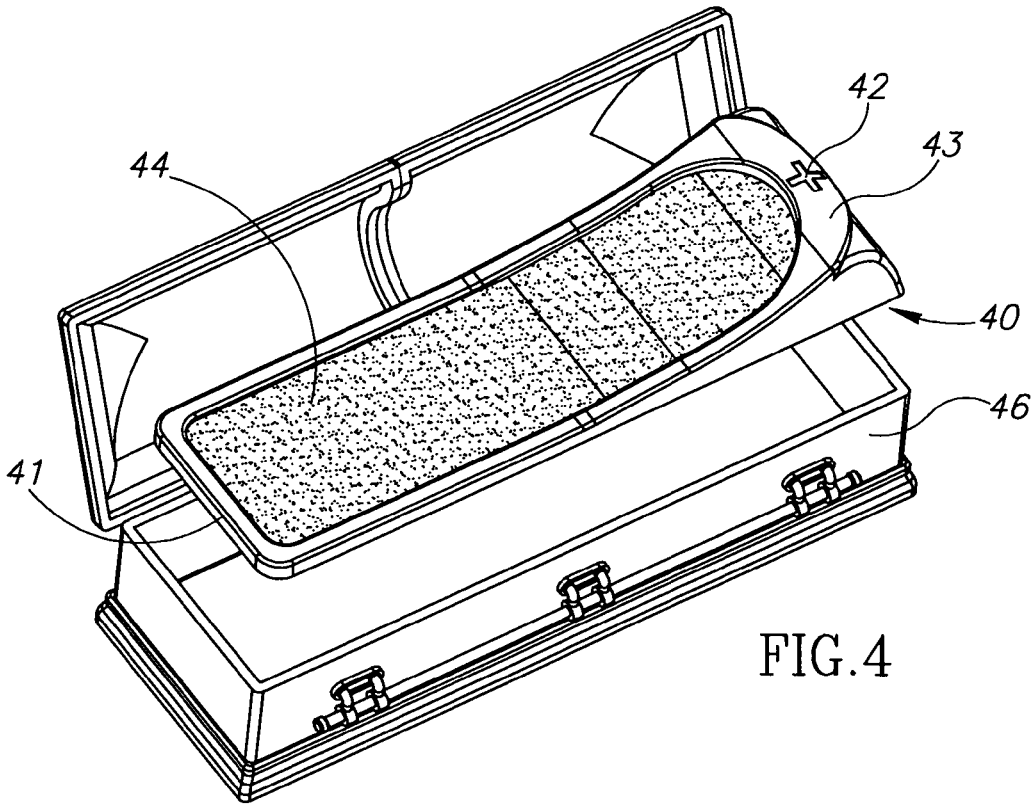
FIG. 4 is a diagram illustrating the burial accessory of the present invention adapted to be placed inside a casket.

A diagram illustrating the burial accessory of the present invention adapted to be placed inside a casket is shown in FIG. 4. In this embodiment, the burial accessory, generally referenced 40, comprises a platform 41, head portion 43, optional symbols 42 and natural material covering 44. The platform comprises an elongated substantially planar and rectangular rigid or semi-rigid board that is covered with soil or other natural material and adapted to be placed inside a casket 46 and used as an internal platform for the corpse. The platform may be constructed from any suitable material such as plastic, wood, metal, ceramic or any other rigid or semi-rigid material. In this example embodiment, a head portion 43 of the platform 41 is slightly higher so that the head of the corpse is slightly raised. The burial accessory 40 is adapted to be placed under the corpse inside the casket. The burial accessory may be attached to the bottom portion of the casket using any suitable means such as, screws, glue, etc. or placed under the corpse within the casket without being affixed to the bottom of the casket. Further, the soil or other natural material is applied to the platform using any suitable means such as glue, paint, trowel, etc.

Figure 5:
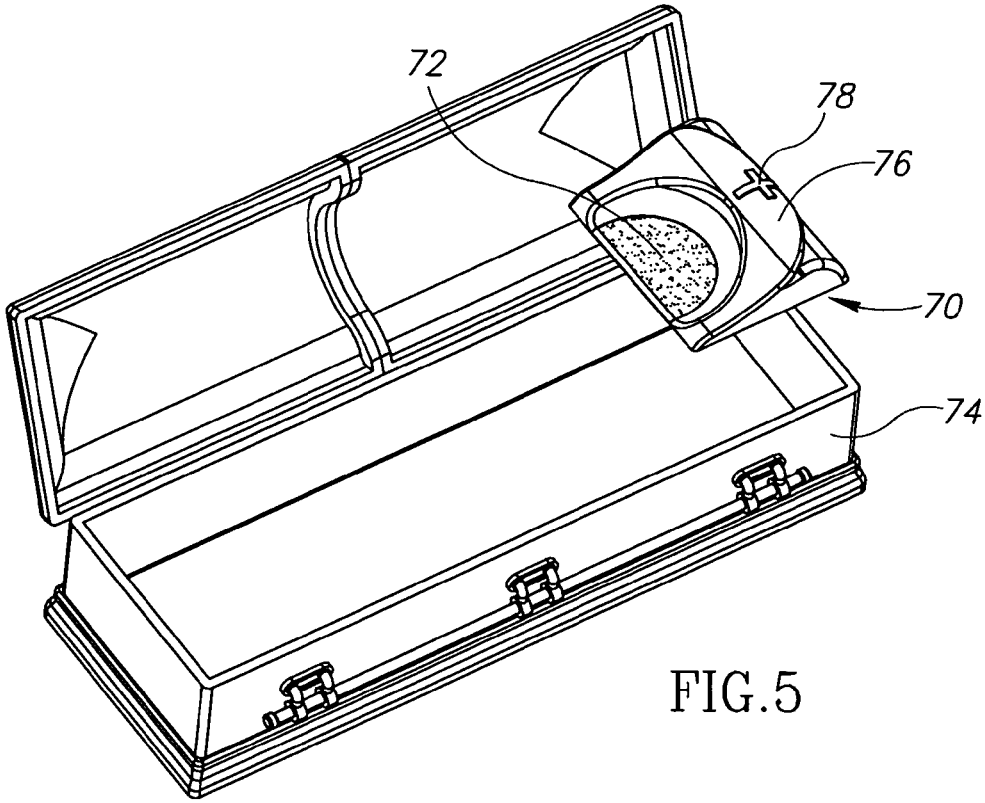
FIG. 5 is a diagram illustrating a burial accessory adapted for the head portion of a corpse and operative to be placed inside a casket.

A diagram illustrating a burial accessory adapted for the head portion of a corpse and operative to be placed inside a casket is shown in FIG. 5. In this embodiment, the burial accessory, generally referenced 70, comprises a rigid or semi-rigid substantially planar platform 76, zero or more symbols (e.g., religious) 78 affixed to the platform and soil or other natural material 72 affixed to either the entire surface or a portion of the platform. The burial accessory 70 is adapted to be placed under the head of a corpse to provide support therefore. It can be affixed to the bottom of the casket 74 or placed under the head of the corpse without attaching it to the bottom of the casket.

Figure 6A:
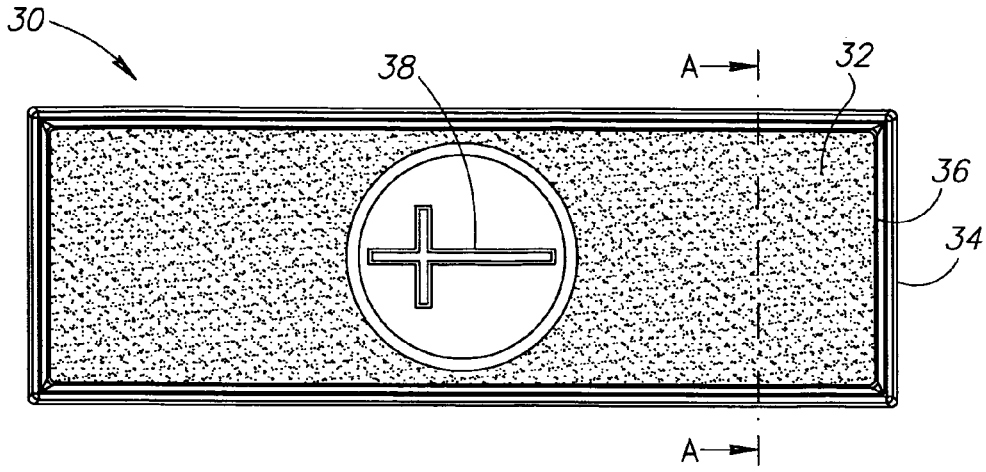
FIG. 6A is a diagram illustrating an isometric view of the burial accessory of the present invention.
Figure 6B:
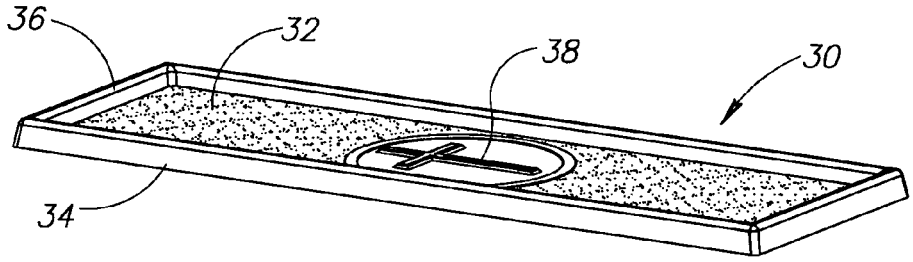
FIG. 6B is a diagram illustrating an upper view of the burial accessory.

A diagram illustrating an isometric view of the burial accessory of the present invention is shown in FIG. 6A and a planar view is shown in FIG. 6B. The burial accessory, generally referenced 30, comprises a platform 34 which is an elongated substantially planar and rectangular rigid or semi-rigid board 34 having a strengthened perimeter frame 36. The platform 34 is coated (i.e. covered) with soil or other natural material 32 using any suitable means, e.g., adhesive, glue, etc. The platform may be constructed from any suitable material such as plastic, wood, metal, ceramic or any other rigid or semi-rigid material.

Figure 6C:
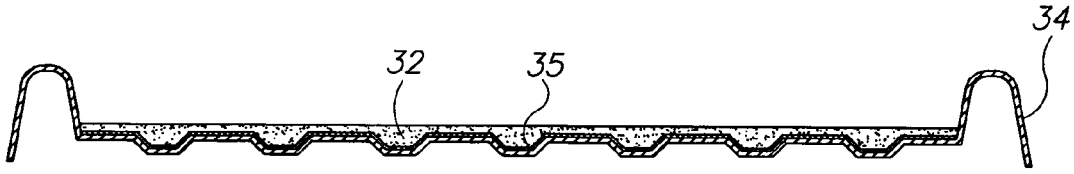
FIG. 6C is a diagram illustrating slice BB in more detail.

A cross-sectional slice AA is shown in detail in FIG. 6C. In this example embodiment, the platform 34 comprises a ribbed structure for strength and rigidity. The ribs can be formed via any suitable technique such as plastics injection molding, vacuum molding, etc. The adhesive or glue is applied to the upper surface of the platform and the soil or other natural material 32 is applied to the adhesive or glue.

Figure 7:
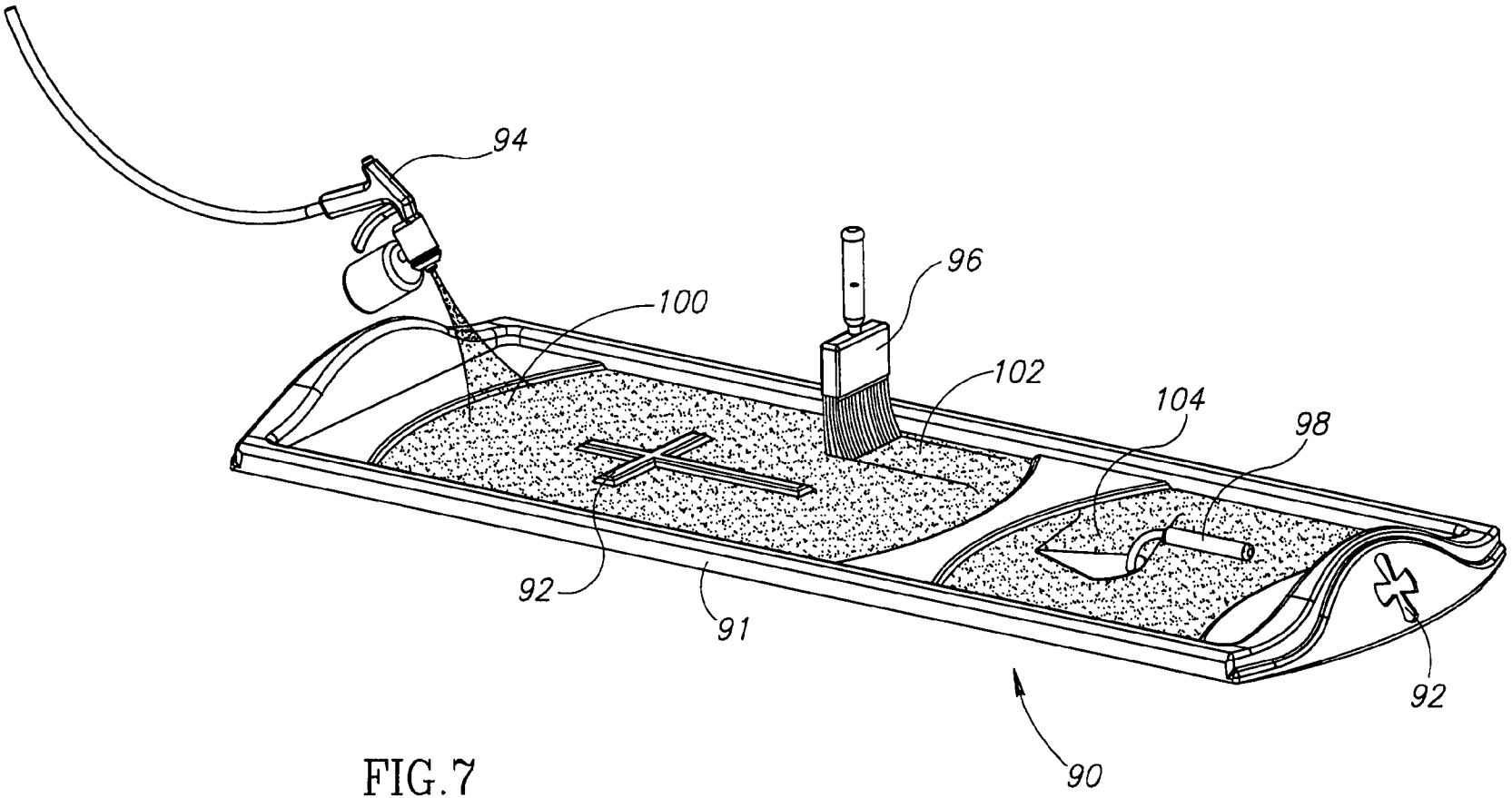
FIG. 7 is a diagram illustrating several example means of covering the platform with natural material.

A diagram illustrating several example means of covering the platform with natural material is shown in FIG. 7. The burial accessory, generally referenced 90, comprises a platform 91 with optional symbols 92. The natural material can be applied to the surface of the platform using any suitable means. The means of application that are suitable may vary depending on the actual material used (e.g., soil, pebbles, etc.) and its consistency (e.g., powder, liquid suspension, etc.). The natural material 100 can be sprayed using air or electric spray gun 94. The material 102 can be painted on using a brush or other applicator 96. Or, the material 104 can be applied using a trowel 98. It is appreciated that other means of application can be used and are contemplated by the invention.

Figure 8A:
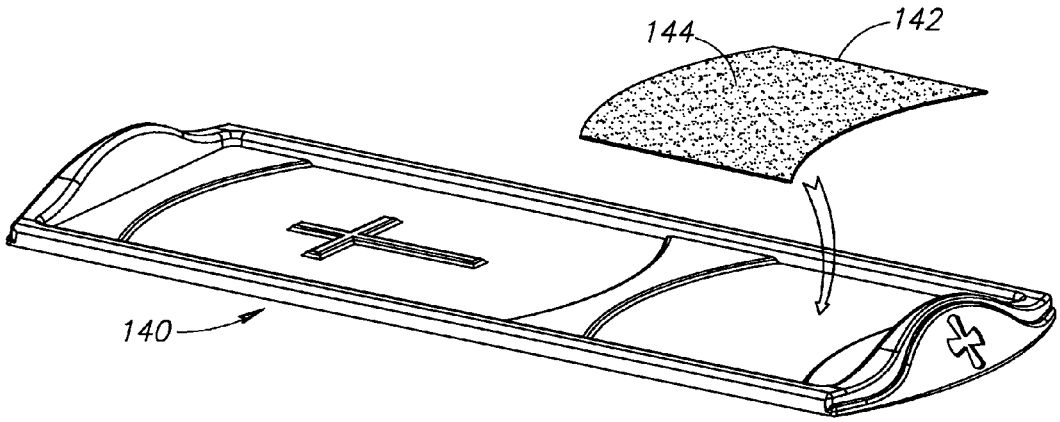
FIG. 8A is a diagram illustrating a panel containing a natural material over a portion of its surface.

A diagram illustrating a panel containing a natural material over a portion of its surface is shown in FIG. 8A. In this alternative embodiment, the burial accessory, generally referenced 140, comprises a platform and one or more panels 142 wholly or partially covered with a natural material 144. The platform may be produced using any suitable means. For example, the panel may be constructed from a plastic resin using a compression or pressing process whereby glue or adhesive materials are added to yield a rigid, semi-rigid or flexible board like panel. The panel is then affixed to the platform which can be used inside or outside a casket.

Figure 8B:
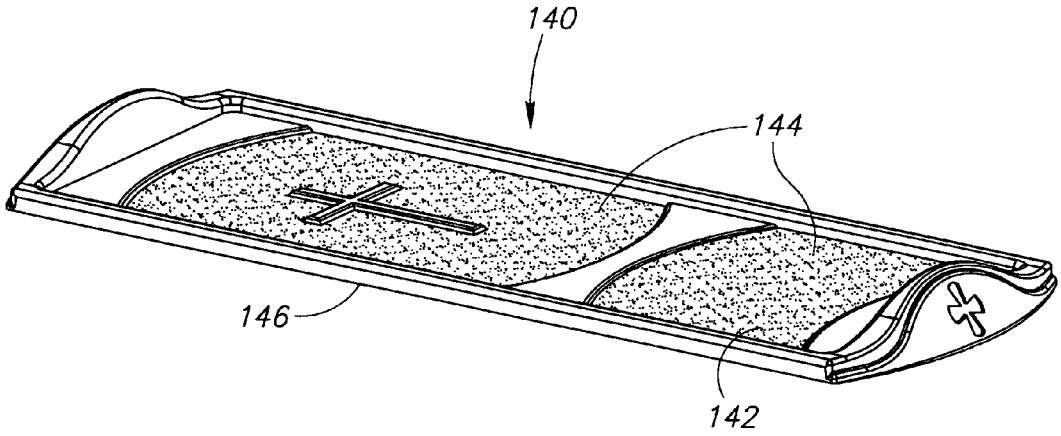
FIG. 8B is a diagram illustrating the panel of FIG. 8A affixed to the platform to form a burial accessory.

The natural material is applied to the wet glue or adhesive. Once dry or cured, the natural material is presently affixed to the panel. Alternatively, the natural material can be mixed with the plastic resin or other material the panel is constructed from. The panel is produced using any suitable process, e.g., molded, pressed, compressed, extruded, etc. wherein the natural material is embedded or impregnated within the panel itself. A diagram illustrating the panel 142 of FIG. 8A affixed to the platform 146 to form a burial accessory 140 is shown in FIG. 8B. The one or more panels (one illustrated in the example embodiment) is affixed to the platform using any suitable means such as glue, adhesive, screws, nails, rivets or any other fastening means.

Figure 9B:
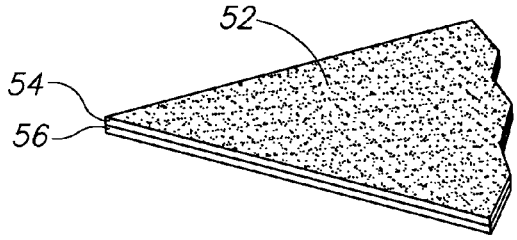
FIG. 9B is a diagram illustrating a corner of the flexible platform of FIG. 9A in more detail.
Figure 9A:
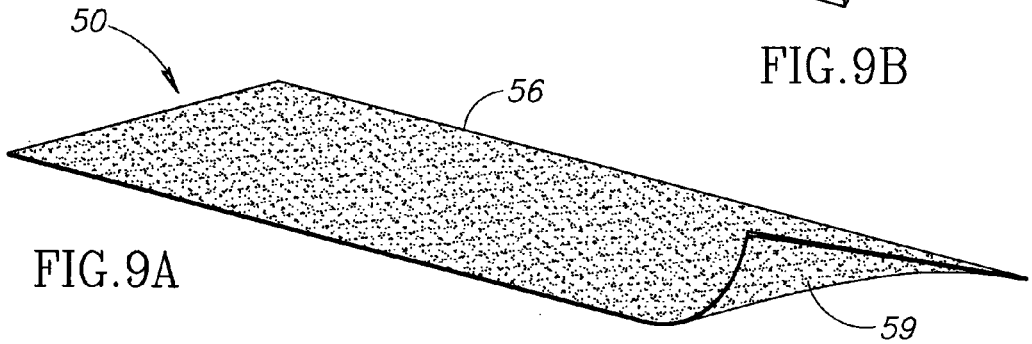
FIG. 9A is a diagram illustrating a flexible platform based burial accessory containing a natural material and adapted to be placed inside a casket.

A diagram illustrating a flexible platform based burial accessory containing a natural material and adapted to be placed inside a casket is shown in FIGS. 9A and 9B. The burial accessory, generally referenced 50, comprises a flexible platform 56 wholly or partially covered with a natural material 52. The platform 56 is constructed from a flexible or sponge like material such as rubber, sponge, fumed polyethylene or polyethylene. It is appreciated that other flexible and sponge like materials are contemplated as well. Those portions of the platform to be covered with the natural material are then covered with a glue or adhesive layer 54. The natural material is applied while the glue or adhesive is wet and once dry or cured, the natural material is permanently affixed to the surface of the platform.

Figure 10:
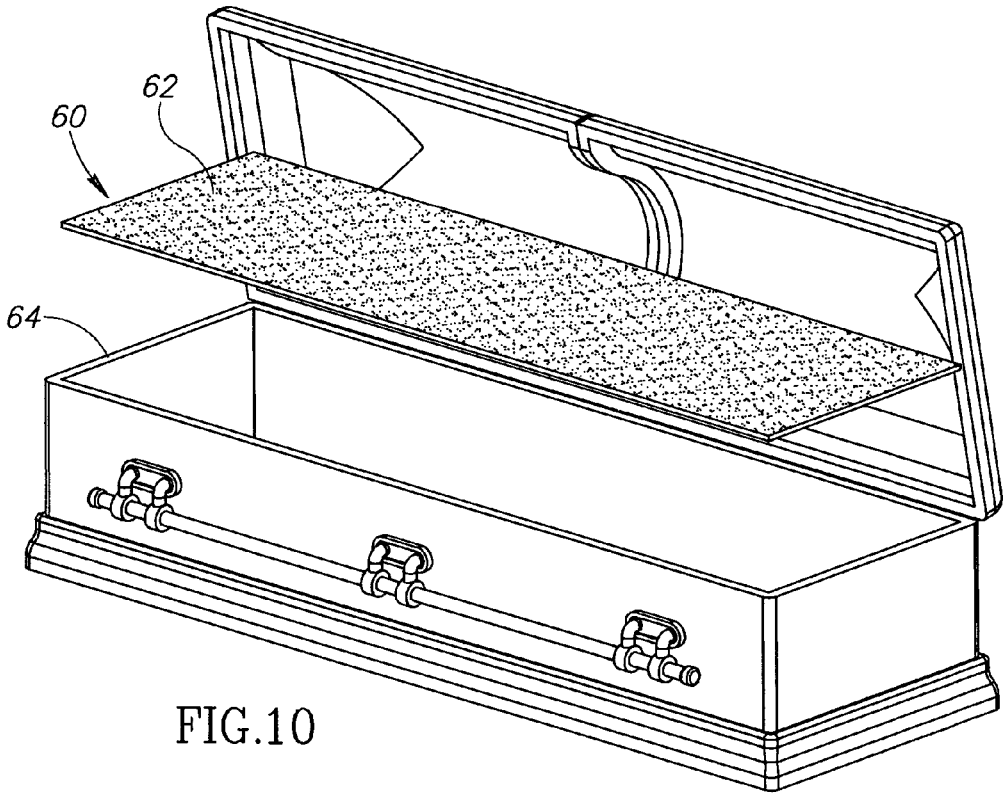
FIG. 10 is a diagram illustrating the placing of a flexible platform based burial accessory inside a casket.

The burial accessory can be used under the corpse within the casket, under the corpse without a casket or under the casket. When used within or under the casket, the burial accessory can be attached to the casket using any suitable fastening means. Note that the burial accessory 50 can be constructed whereby both sides of the flexible platform are covered with the natural material as shown in FIG. 10. The flexible platform 56 comprises an upper surface and a lower surface. One or both sides may be wholly or partially covered or coated with the natural material 52. The example embodiment illustrated herein in FIG. 9A shows the flexible platform with its lower surface optionally covered with the natural material 59.

A diagram illustrating the placing of a flexible platform based burial accessory inside a casket is shown in FIG. 10. The burial accessory constructed from a flexible or sponge like material, generally referenced 60, is covered or coated wholly or partially with the natural material 62 and is adapted to be used as a platform and placed under the corpse within a casket 64. As stated supra, the burial accessory 60 constructed from a flexible or sponge like material may be placed under the corpse without the casket or placed or affixed under the casket depending on the particular burial process.

Figure 11:
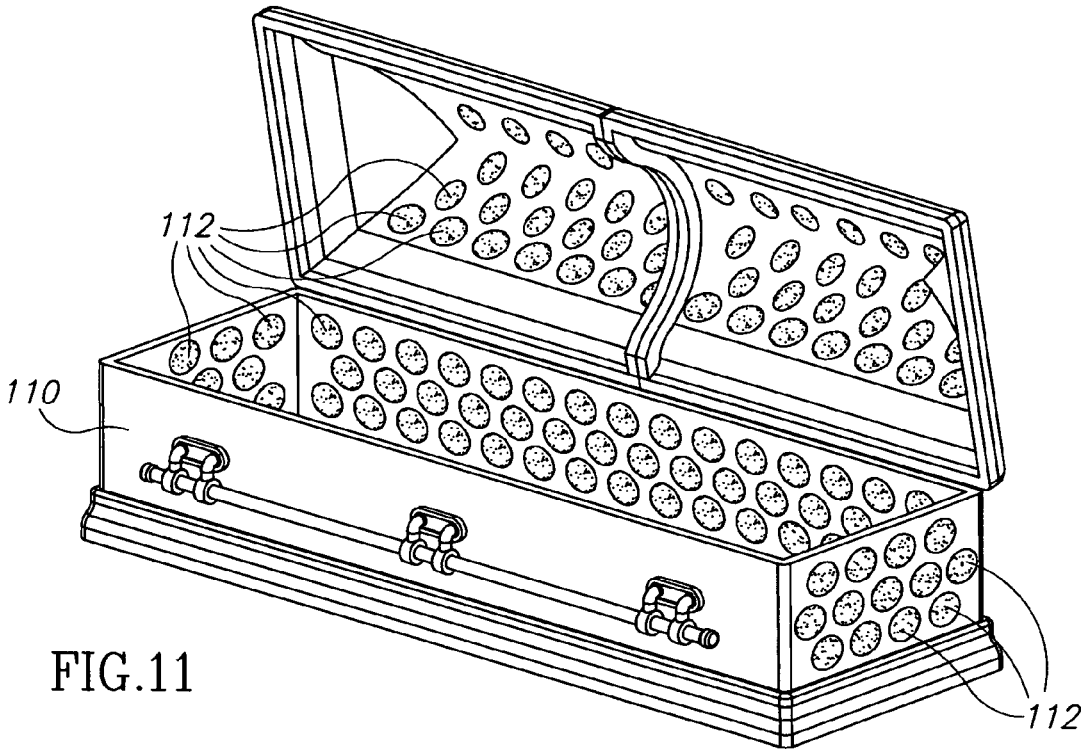
FIG. 11 is a diagram illustrating a casket having a portion of its interior surface and optionally its exterior surface covered with a natural material.

A diagram illustrating a casket having a portion of its interior surface and optionally its exterior surface covered with a natural material is shown in FIG. 11. In this alternative embodiment, the natural material 112 is coated onto one or more portions of the interior and/or exterior surface of the casket 110. The natural material, e.g., soil, is applied to the interior and/or exterior surface of the casket using any suitable technique, e.g., spray, paint, trowel, etc. An adhesive or glue material is first applied and while wet, the natural material is applied onto the glue or adhesive. Once dry or cured, the natural material is permanently adhered to the surface of the casket.

Figure 12:
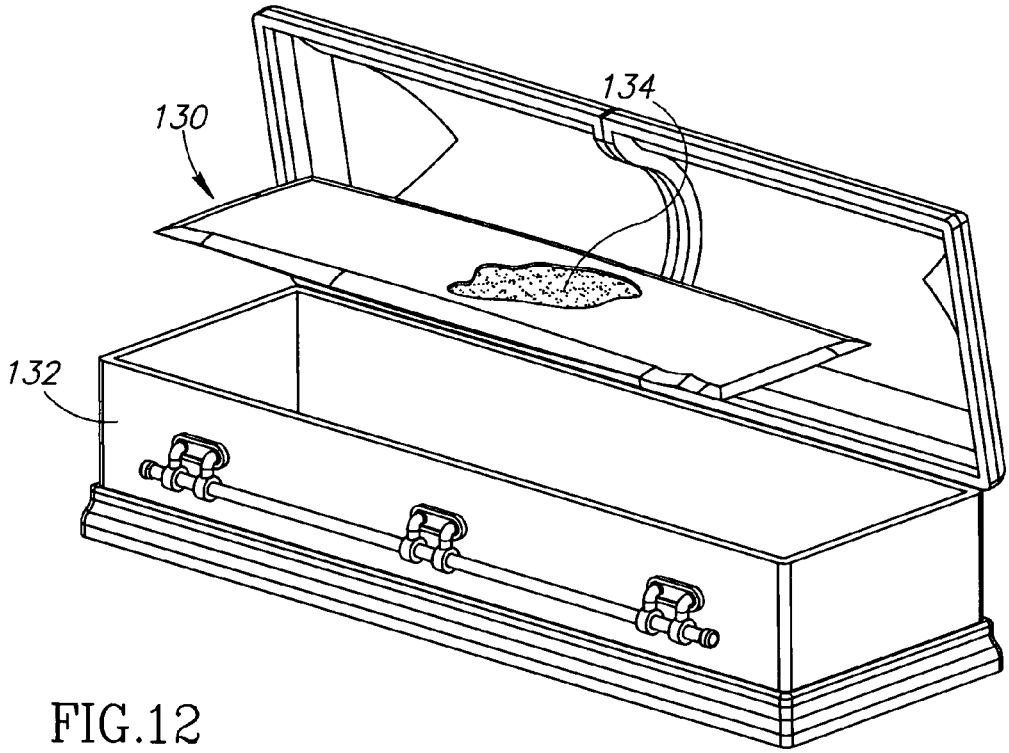
FIG. 12 is a diagram illustrating an elongated planar bag or sack containing natural material and adapted to be placed under a corpse within a casket.

A diagram illustrating an elongated planar bag or sack containing natural material and adapted to be placed under a corpse within a casket is shown in FIG. 12. In another alternative embodiment, the burial accessory, generally referenced 130, comprises an elongated rectangular substantially planar bag or package containing a natural material 134. The burial accessory bag or package can be sealed or unsealed and may be constructed from any suitable material such as plastic, cloth, burlap, nylon, etc. Further, the bag may be wholly or partially filled with soil or other natural material. The burial accessory 130 is adapted to be placed freely within or affixed to the bottom of a casket 132 and serves as a platform for a corpse. Alternatively, the burial accessory 130 can be placed under a corpse (if buried without a casket), may be placed under a casket or affixed to the underside of a casket.

Figure 13:
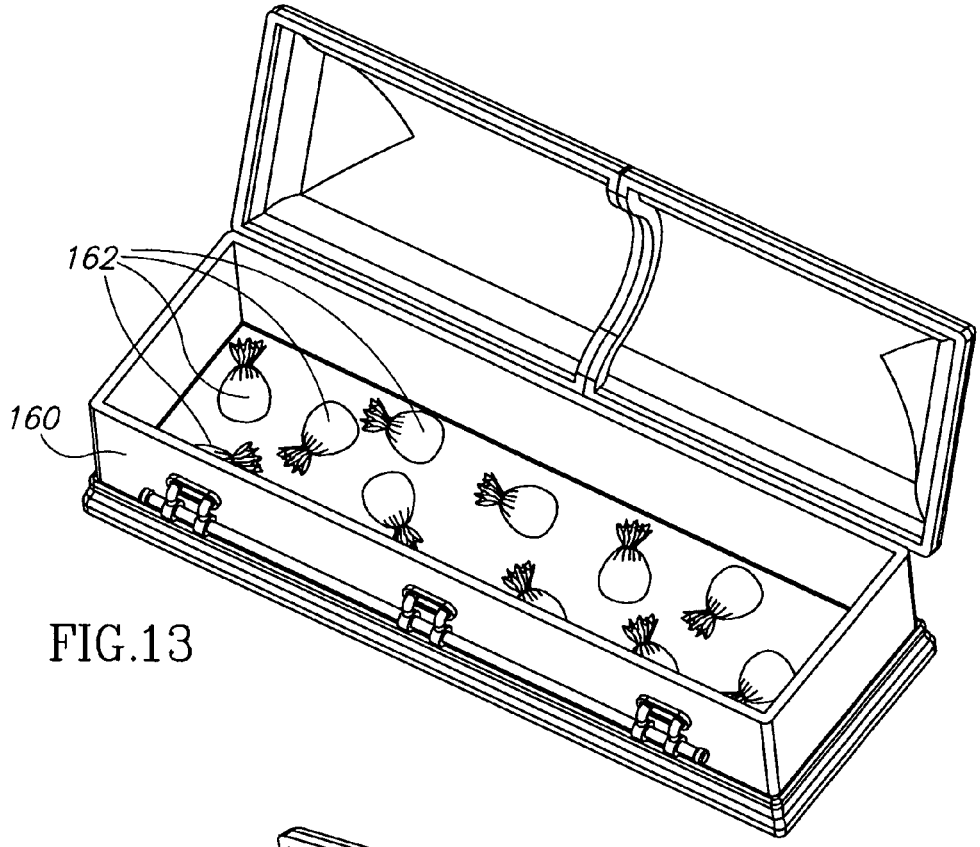
FIG. 13 is a diagram illustrating a plurality of bags containing natural material and freely scattered within a casket.

A diagram illustrating a plurality of smaller bags containing natural material and freely scattered within a casket is shown in FIG. 13. In an alternative embodiment, a plurality of burial accessories 162 comprising bags of natural material are freely scattered throughout the interior portion of a casket 160. The bags are typically sealed but need not be and may be constructed from any suitable material such as plastic, cloth, burlap, nylon, etc. Further, the bag may be wholly or partially filled with soil or other natural material.

Figure 14:
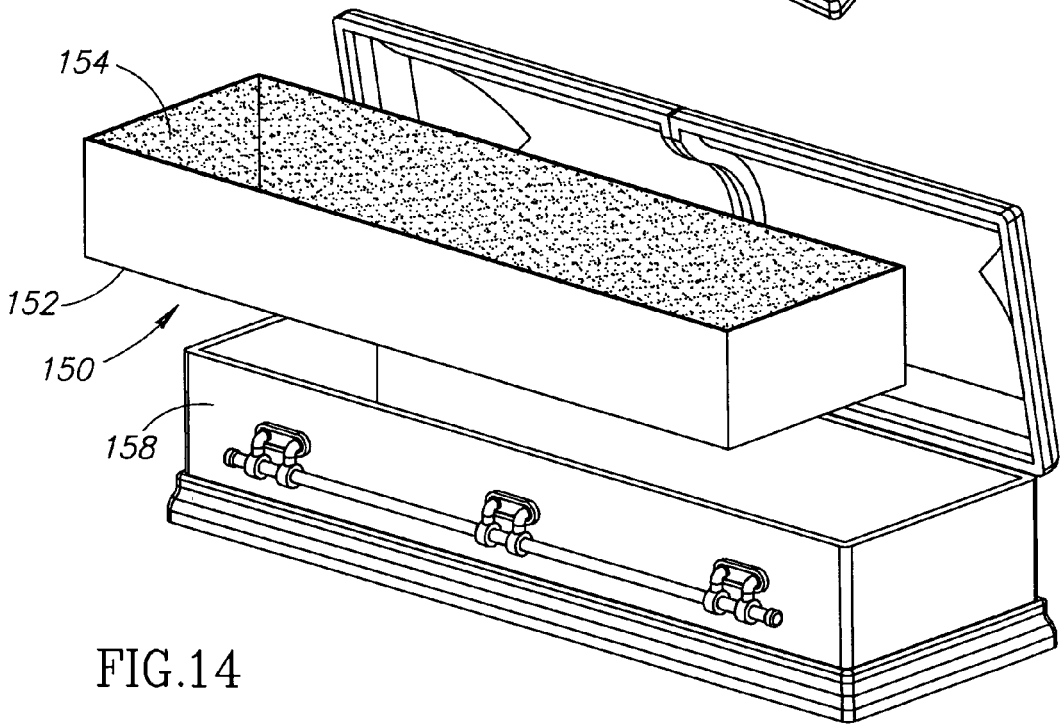
FIG. 14 is a diagram illustrating a liner coated with a natural material and affixed to the inner walls of a casket.

A diagram illustrating a liner coated with a natural material and affixed to the inner walls of a casket is shown in FIG. 14. In this alternative embodiment, a burial accessory, generally referenced 150, comprises a liner 152 coated or covered wholly or partially with soil or other natural material 154. The burial accessory 150 is adapted to be placed within the interior portion of a casket 158. The burial accessory may be fastened to the interior of the casket using any suitable means, such as glue, adhesive, screws, nails or any other fastening means, or alternatively, may simply be placed within the casket without any fastening.

It is intended that the appended claims cover all such features and advantages of the invention that fall within the spirit and scope of the present invention. As numerous modifications and changes will readily occur to those skilled in the art, it is intended that the invention not be limited to the limited number of embodiments described herein. Accordingly, it will be appreciated that all suitable variations, modifications and equivalents may be resorted to, falling within the spirit and scope of the present invention.

What is claimed is:

1. A casket liner for placement inside a casket, comprising:

soil obtained from a specific location and selected to express a connection between a deceased and said specific location; and a substantially planar platform adapted to be at least partially covered by said soil and operative to be used in a burial process, wherein said soil is permanently adhered to one or more portions of the surface of said platform thus exposing said soil for contact with the deceased.

2. The burial accessory according to claim 1, wherein said natural material comprises a material identified by its place of origin where said deceased has a sentimental or religious connection thereto.

3. The burial accessory according to claim 1, wherein said platform is adapted for the full length of a corpse.

4. The burial accessory according to claim 1, wherein said platform is adapted for only the head portion of a corpse.

5. The burial accessory according to claim 1, wherein said platform is constructed of a rigid plastic.

6. The burial accessory according to claim 1, wherein said platform is constructed of flexible material.

7. The burial accessory according to claim 1, wherein said platform is adapted to be fastened to the underside of a casket.

8. The burial accessory according to claim 1, wherein said platform is adapted to be placed under a corpse inside a casket.

9. The burial accessory according to claim 1, wherein said platform is adapted to placed under a corpse to be buried without a casket.

10. The burial accessory according to claim 1, wherein said platform is constructed using a material already containing said soil.

11. The burial accessory according to claim 1, further comprising one or more planar panels at least partially covered with said soil and adapted to be fixably attached to said platform.

12. The burial accessory according to claim 1, further comprising one or more planar panels at least partially impregnated with said soil and adapted to be fixably attached to said platform.

13. A method of manufacture of a burial accessory for use in a burial process of a deceased, said method comprising the steps of:

forming an elongated substantially planar platform;

applying an adhesive coating to one or more portions of said platform to be covered with soil having a sentimental or religious value for said deceased;

applying said soil to said adhesive; and permitting said adhesive to dry, thereby permanently adhering said soil to said platform and providing said burial accessory for use in said burial process of said deceased.

14. The method according to claim 13, wherein said soil is from a specific location having a sentimental or religious value for a deceased.

15. The method according to claim 13, wherein said soil is obtained from a specific location and chosen to express a connection between a deceased and said specific location.

16. The method according to claim 13, wherein said step of forming comprises the step of injection molding.

17. The method according to claim 13, wherein said step of forming comprises the step of vacuum forming.

18. A method of manufacture of a burial accessory for use in a burial process of a deceased, said method comprising the steps of:

mixing soil, obtained from a specific location and chosen to express a connection between said deceased and said specific location, with plastic resin material to yield a plastic combination therefrom;

molding said plastic combination to produce a molded plastic having a desired shape; and permitting said molded plastic to cure such that said soil is embedded in said molded plastic, providing said burial accessory for use in said burial process of said deceased.

19. The method according to claim 18, wherein said soil comprises soil having a sentimental or religious value for a deceased.

20. The method according to claim 18, wherein said soil comprises a material identified with its place of origin wherein a deceased has a sentimental connection therewith.

21. A casket liner for use in a casket, comprising:

a substantially rectangular shaped body comprising a base and four upwardly extending peripheral walls defining an interior surface of said body; and soil, obtained from a specific location and chosen to express a connection between a deceased and said specific location, permanently adhered to one or more portions of said interior surface of said body, wherein said soil is exposed for contact with said deceased.

22. The liner according to claim 21, wherein said liner is vacuum molded from a plastic resin.

23. A casket liner for placement inside a casket, comprising:

soil obtained from a specific location and selected to express a connection between a deceased and said specific location; and a substantially planar platform adapted to be at least partially covered by said soil and operative to be used in a burial process, wherein one or more portions of said platform are impregnated with said soil and exposed for contact with the deceased.

24. A casket liner for placement inside a casket, comprising:

a substantially rectangular shaped body comprising a base and four upwardly extending peripheral walls defining an interior surface of said body;

soil obtained from a specific location and chosen to express a connection between a deceased and said specific location; and wherein one or more portions of said body are impregnated with said soil.

* * * * *